United States Patent [19]

Malek

[11] 4,056,460

[45] Nov. 1, 1977

[54] PROCESS FOR LIQUEFYING CARBONACEOUS MATERIALS OF HIGH MOLECULAR WEIGHT AND FOR SEPARATING LIQUEFACTION PRODUCTS

[76] Inventor: John M. Malek, P.O. Box 71, Lomita, Calif. 90717

[21] Appl. No.: 636,450

[22] Filed: Dec. 1, 1975

[51] Int. Cl.[2] ..... C10G 1/06

[52] U.S. Cl. ..... 208/8

[58] Field of Search ..... 208/8, 10

[56] References Cited

U.S. PATENT DOCUMENTS

| | | | |
|---|---|---|---|
| 1,280,178 | 10/1918 | Day | 208/8 |
| 1,838,547 | 12/1931 | Haslam et al. | 208/8 |
| 1,925,551 | 9/1933 | Wietzel et al. | 208/8 |
| 2,141,615 | 12/1938 | Pott | 208/8 |
| 2,191,156 | 2/1940 | Pier et al. | 208/10 |
| 2,202,901 | 6/1940 | Dreyfus | 208/8 |
| 2,654,695 | 10/1953 | Gilbert et al. | 208/10 |
| 3,158,561 | 11/1964 | Newworth et al. | 208/8 |
| 3,341,447 | 9/1967 | Bull et al. | 208/8 |

*Primary Examiner*—Delbert E. Gantz
*Assistant Examiner*—James W. Hellwege

[57] ABSTRACT

Process characterized by comprising successively a dissolution zone fed with carbonaceous solids and with a solvent, a high pressure hydrogenation zone provided with a source of hydrogen, and a hydrogenation products separation zone, wherein the improvement consists mainly in chemical upgrading of the liquidform products derived from the separation zone, and recycling a part of the upgraded products to the dissolution zone, this recycled part being of either positively acidic or positively basic properties for enhancing the dissolution - decomposition of base-acid structures present in the carbonaceous solid feed.

15 Claims, 1 Drawing Figure

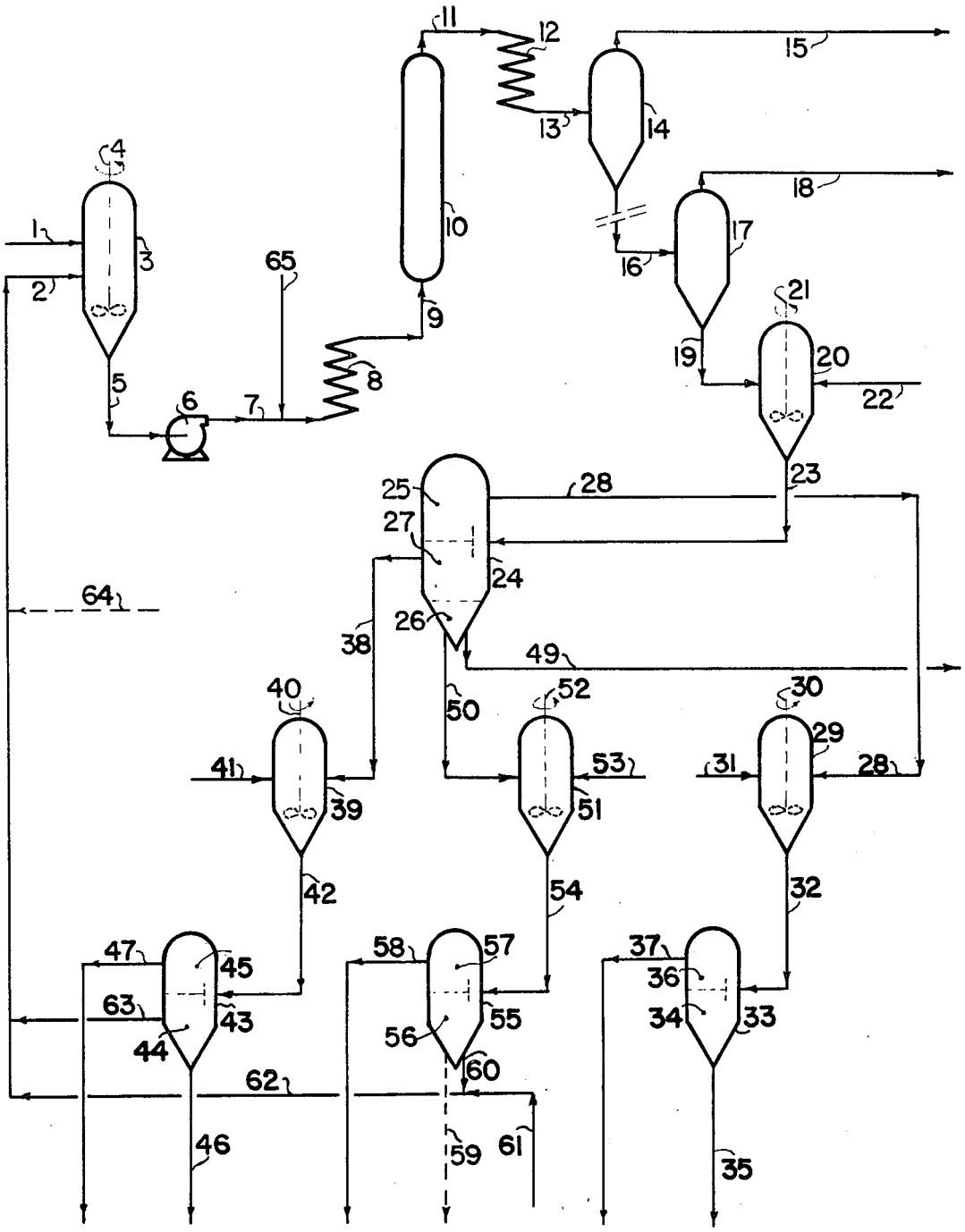
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
49
50
51
52
53
54
55
56
57
58
59
60
61
62
63
64
65

PROCESS FOR LIQUEFYING CARBONACEOUS MATERIALS OF HIGH MOLECULAR WEIGHT AND FOR SEPARATING LIQUEFACTION PRODUCTS

This invention relates to processes for liquefying high molecular weight carbonaceous materials, like subbituminous or bituminous coals, in order to produce liquid and gaseous fuels; and it is particularly directed toward improving the value of the products and the physical and chemical characteristics of the media in which essential operations of the process are performed.

The object of the inventon are improvements to processes for coal hydroliquefaction comprising subjecting the coal to decomposition and to reactions with hydrogen under elevated pressure and temperature to yield desired hydrocarbons in a mixture of gasiform and slurryform products comprising liquid and solid products, and then separating the gasiform products from the slurryform ones, wherein the improvements mainly consist of chemically decomposing and upgrading said separated slurryform products, by means of agitating the latter with alkalis or acids separating products of the decomposing and upgrading operations, and preferably reusing a part of the upgraded products in the process, in order to increase the efficiency of the latter, while possibly increasing the market value of the remaining part.

Following known flow diagrams for processes producing liquid and gaseous fuels by coal liquefaction, those processes sometimes provide for recycling and admixing a part of the liquid products of the coal liquefaction to the coal feed, this recycled liquid part serving as solvent of the coal, and sometimes they provide for recycling a part of the slurryform liquefaction product, without chemically breaking the viscosity of this product, and without enriching the recycled products in specific products upgraded by means of chemical treatments other than hydrogenation, in order to improve the technological qualities of the feed to the process, and to increase the production yields.

It has been observed that usually the most efficient solvents for dissolving carbonaceous materials, like subbituminous or bituminous coal, are either amines or phenols with high liquid dissociation constants (basic dissociation constant for amines, and acid dissocioation constant for phenols), and aromatic hydrocarbons with high polarities, and that, on the other hand, the viscosity of the solvent has to be kept as low as possible if high dissolution rates are desired. Furthermore, if subsequently to the dissolution of the coal, the latter in the solution is subjected to a hydrogenation or like reactions, a high viscosity gives a negative effect on the hydrogen or other reactants transfer, and on the reaction yields. p It was expected and has been confirmed that phenolic materials, called aphaltenes, have the highest impact on the viscosity of the coal liquefaction medium. The phenolic materials are characterized in their chemical structure by the presence of polyphenols and phenols compounded with basic nitrogen groups, forming polymer and polycondensate type products of a high molecular weight, high boiling point, and high viscosity. In fact, it has been found that the decomposition of such compounds leads to lower overall viscosities of their solutions and slurries, while decreasing also their average molecular weight and boiling point, and furthermore that the products of that decomposition may be economically upgraded in their useful qualities.

The present invention is the result of conclusions mainly from above findings and facts, and of a translation of these conclusions into the language of practical and commercial applications.

One conclusion is that if an amine which is a basic organic compound is a good solvent of coal which comprises asphaltenes, the latter, when being dissolved, chemically react with the solvent and decompose since they have acidic-basic structures where basic groups weaker than the one of the applied amine are being released and form free bases; and the stronger the applied solvent is as a base, the larger is the number of freed basically weaker components. An analogous conclusion can be drawn for the case of a phenol being used as a coal solvent; the higher the acidity of the former, the larger the range of weaker phenolic and other acidic groups subjected to a release in the form of free weaker acids. Since, on the other hand, the weakest organic bases and the weakest organic acids are compounds with generally the highest molecular weight and the highest boiling point, the acidic-basic substitutes have, in general, a molecular weight lower than molecular weight of the acid-base structure in the asphaltene, and also the boiling point and the viscosity are respectively lower.

A subsequent conclusion is that since the operating temperature in the coal liquefaction medium has generally to be eleyated for decreasing the viscosity of the medium in which the hydrogenation occurs and for improving the hydrogen diffusion and activity therein, this high temperature however enhancing secondary and undesired reactions in repolymerizations of certain reactants and in excessive coking, giving technologically negative effects, said operating temperature may be lowered in order to avoid the impact of these negative effects on the production, if the average molecular weight and viscosity of the solution are initially lowered.

Another conclusion is that since the hydrogen transfer rates in the medium in which a hydrogenation has to occur seems to be a certain function of the basic, neutral or acidic characteristic of the solvent, as well as of the polarities of the solution components, depending on the chemical and acid-base nature of the carbonaceous material, the best desired basic or acidic average dissociation constant for the solvent has to be determined for each given coal to be treated, and the best desired acidity or basicity in the coal hydroliquefaction medium should be controlled as the pH of the medium during the operation. A logical conclusion is to apply a solvent with a basic or acidic character in the process, and to make this decision depending on the chemical characteristics of the given coal, and on the behaviour of that solvent versus hydrogen transfer during the hydrogenation.

For example if a bituminuos coal is characterized by asphaltenes in which the acidic to basic components are in a molecular ratio of 1/2, the application of a basic type solvent for binding acids from the asphaltenes, and for releasing correspondingly 2 moles of relatively weaker bases per each mole of the acids being bound, would be recommended, but if the resulting medium shows disadvantageous effects on the hydrogenation efficiency, an acidic type solvent with good hydrogen transfer capabilities should be used.

Another conclusion is that asphaltenes still present in the hydrogenation products should not be recycled and admixed with the coal feed so as to not increase the viscosity of the coal liquefaction medium and subsequently to avoid exerting hindering effects on the production.

Yet another conclusion is that since amines and other basic nitrogen compounds as well as phenol and other organic acids are present in limited amounts in coal liquefaction products, said compounds should be separately recovered from said products, and at least a part of the recovered material should be recycled as solvent to the coal liquefaction operation, in order to appropriate to the medium in which coal is being liquefied a positively acidic or a positively basic character; wherein such character could be defined by the acidity-basicity value expressed in terms of liquid dissociation constants and the pH of the medium but if a building of such recovered solvent being recycled in the process occurs and adversely effects the production this solvent should be converted into technologically more desirable solvent components or removed from the process, or for upgrading it to more valuable and marketable products. So, for example, phenols recovered from the hydrogenation products may be alkylated and preferably methylated to yield corresponding alkylated aromatics (phenol being converted into toluene, cresols into xylenes, etc) if the latter present good hydrogen transferring properties, and in this form they may be used for coal liquefaction.

In translating these conclusions into useful applications I have devised an improved process, related to the hydroliquefaction of coal, wherein in order to obtain separately phenol with phenol homologues and other organic acids, and separately — amines with other basic nitrogen compounds, from the slurryform separted from the gasiform products of the coal hydrogenation, it is proposed to admix to these separated slurryform products an alkaline hydroxide, like sodium hydroxide, preferably in water solution, and agitating the resulting mixture for binding phenolic and other organic acidic groups present in these slurryform products, while forming a water solution of salts and adducts of phenols and other organic acids with said base, and liberating organic bases (of an alkalinity weaker than the one of the applied inorganic hydroxide), composed mainly of arylamines and other basic nitrogen compounds which essentially are water insoluble but soluble in hydrocarbon oils; and then separating the solid residue rich fraction and the oil fraction which comprises dissolved arylamines from the water solution rich fraction which comprises phenolic salts.

Afterwards, these phenolic salts in water solution are subjected to the action of a strong inorganic acid, like sulfuric or hydrochloric acid, preferably in a water diluted form, in order to convert these salts to free phenols like monohydroxybenzene (phenol), cresols, xylenols, naphtols, etc., which optionally are then recycled, at least in part, to the process for liquefying coal. However, before possibly returning such mixture of phenols which comprise phenol homologues of a higher molecular weight, higher viscosity and boiling point, to the process, this mixture may optionally be subjected to a separate conventional hydrogenation in order to lower the average molecular weight and viscosity. The phenols not being returned to the process are preferably purified to make them more marketable as valuable products.

To recover the amines and other basic organics from the separated oil portion in which they are dissolved, this fraction is preferably chemically treated in an agitated condition with a strong inorganic acid diluted with water, for yielding acid-amine compounds which are water soluble and therefore-separable from the oil, and which, in their water solution, once separated from oil, can be subjected to the recovery of valuable liquid arylamines like aniline, toluidines, quinoline, alkyl substituted pyridines and quinolines, etc, in conventional treatment and separation steps.

Of course, at least a part of amines liberated from the slurryform products of coal hydroliquefaction can be recycled to the process for liquefying coal if no phenols are being returned there.

The solid residue rich fraction separated from the water solution rich fraction can be chemically treated in an agitated condition with a diluted inorganic acid, like sulfuric acid, to form a pasteform fraction composed essentially of mineral solids in a heavy oil medium, and a solution fraction comprising salts and adducts of heavier arylamines and other organic bases with the applied acid. This solution fraction once separated from the mineral solids rich fraction may be subjected to conventional treatments and separation steps to yield purified heavier arylamines and their substitutes, while the separated mineral solids rich fraction may be disposed off, partly recycled to the process, or subjected to further processing.

A less preferable but still valid procedure of the invention is to apply first a diluted strong acid such as sulfuric acid, hydrochloric acid or like inorganic acid, instead of an alkaline hydroxide to the raw slurry product of the coal hydroliquefaction, to yield free phenols with other liberated organic acids, as well as salts and adducts of the applied acid with amines and other basic structures present in that slurry, and then to proceed analogically as in the case of an initial alkaline treatment but replacing acids with alkalis and vice versa: once the liquid fraction comprising salts and adducts, in the form of an aqueous solution is separated from the oil fraction comprising dissolved phenols and from solid coal hydroliquefaction products, said salts and adducts are subjected to the chemical action of an appropriately strong inorganic base, preferably diluted with water, in order to convert them to free amines and other organic basic compounds. Following this form of the invention also, at least a part either of amines or phenols may be recycled to the process for admixing them to the coal for liquefaction, while the non-recycled part can be subjected to recovery-separation operations for yielding better marketable products.

A preferred form of the present process is illustrated in the accompanying drawing FIG. 1 is a simplified flow diagram of the process including main equipment (excepting most heat exchangers) to serve as a better understanding of the process, all the considered process apparatus being called a system in the following description with regard to the drawing.

Following this flow diagram, a coal in a powdered form, with particles preferably in the range of 200 mesh size, is brought through the feed line 1, and a solvent rich slurry brought through the line 2, both to the mixer 3 provided with an agitator 4. In this mixer, the particulate coal is thoroughly mixed with the solvent rich slurry, and the resulting slurryform or pasteform mixture is transferred through the outlet line 5 and the high pressure service pump 6 into the pump discharge line 7 into which hydrogen gas is introduced through the line 65, and then the heterogenous mixture is preheated in the heater 8 and sent, through the line 9 into high pressure hydrogenation reactor 10. (In this reactor, the coal dissolution started once the coal has been subjected to the action of the solvent in the mixer 3, and continued during the transfer and especially in the preheater 8 and hot line 9, and practically reaches the dissolution limits, as well as the limits of the hydrogenation once the slurryform mixture was subjected to the action of hydrogen gas fed through the line 65). The hydrogenation products comprising gases and vapor, and a liquid slurry, formed by a liquid solution and solid residues including ash and other undissolved materials, are discharged from the reactor by the pipe 11, through a cooler - condenser 12 and pipe 13 into a first separating vessel 14 where the gases and uncondensed vapor are separated from the slurryform product and removed from the system through the line 15, while the slurryform product goes through the discharge line 16 and one or more flash separating vessels represented on the drawing by the vessel 17 in which the entering slurryform product expands due to a lower pressure condition, and consequently a partial vaporization of the liquid in the slurryform material occurs; the flash vapor is removed from the system through the line 18, while the concentrated slurry is discharged, through the pipe 19, into the mixer 20 provided with an agitator 21, with a pipe 22 for supplying the mixer with diluted caustic soda (in amounts necessary for binding acidic organic groups like phenolic and carboxylic ones available in the slurry material), and with a discharge pipe 23 for transferring the product of mixing the slurry with caustic soda to the settler- separator 24 wherein the slurry forms mainly three different layers: a top layer 25 of oil with dissolved amines and other basic organics generally comprising nitrogen heterocyclics, a bottom solid rich layer 25 including essentially ash, solid residues, water and oil insoluble sodium salts of high molecular weight acidic materials, and some heaviest oil fractions, and an intermediary liquid layer 27 rich in water solution of sodium salts of lighter molecular weight acidic materials like lighter phenols and carboxylic acids, this water solution comprising also small amounts of dissolved ligher amines and other partly water soluble organic materials. The contents of each of the three layers are separately withdrawn from the settler:

1. the oil layer-through the pipe 28 goes into an oil purifier 29 provided with an agitator 30 and a feed line 31 for diluted sulfuric acid for reacting with the amines dissolved in oil and the entrainments of caustic soda and its salts, the product of mixing and reactions being discharged through the pipe 32 into a separator- settler 33 where this product forms two layers: a lower layer 34 rich in a water solution of sulfate salts and adducts of amines and other organic bases, and traces of organic acids, the contents of this layer being removed, through the discharge line 35 from the system and then they may be subjected to further separation and processing steps like treatment with alkalis, filtration, extraction, etc, to yield such possibly marketable products such as aniline, toluidines, quinoline, and other aryl - amines relatively well soluble in aromatic hydrocarbons, and an upper layer 36 of the relatively purified oil, this oil being removed from the separator as the main liquid oil raw product of the process, through the line 37, to be handled outside the system in such oparations as filtration, distillation, etc, 2. the water solution rich contents of the layer 27 in the settler 24 are withdrawn, through the line 38, into the reconverting vessel 39 provided with an agitator 40, feed pipe 41 for bringing a diluted mineral acid like sulfuric acid into the vessel, and a transfer line 42 through which the products of reconversion of the components of said water solution, such as free phenols and other relatively weak organic acids, as well as salts and adducts of lighter amines with the reconverting acid, are sent to a separator 43 wherein the reconversion products separate into two portions: a lower layer 44 rich in liquid acidic organics with a certain amount of solid precipitates depositing at the bottom, these liquid acids being withdrawn through the pipe 63, while the solids-through the drain line 46 are removed from the system, and an upper layer 45 comprising a water solution of relatively small amounts of amine salts and adducts; this solution being removed from the system through pipe 47, possibly to a conventional separation processing of aryl-amines for yelding mainly lighter amines of better water solubilities;

3. the solid rich bottom layer 26 leaves the settler 24 in two streams through the pipes 49 and 50 respectively. The stream through the pipe 49 goes to further treating and processing steps outside the system, while the other solids rich stream is discharged from the pipe 50 into a reconverter - mixer 51 provided with an agitator 52 and with a feed line 53 for bringing a diluted mineral acid like sulfuric acid into the reconverter, and with a transfer line 54 through which the products of reconversion of the solid rich material with the acid are sent to a settler - separator 55 where these products form two main layers: a lower pasteform layer 56 of essentially mineral solids in a heavy oil medium, and an upper layer 57 formed by a solution rich in salts and adducts of heavier aryl - amines and like organic bases with the applied mineral acid. This solution leaves the system through the pipe 58, to be subjected to further product separating oparations in order to yield such materials as xylidines, quinoline, and alkyl substituted pyridines and quinolines of higher boiling point and molecular weight. The content of the layer 56 is optionally partly withdrawn through the pipe 59 as a solid "blowdown" for disposal or for a further processing, for example by subjecting it to a gasification, outside the system, while at least the main portion of that content is moved through the discharge pipe 60 while being entrained by solvent arriving through the pipe 61 with which the former pipe is connected to form a transfer line 62, this one being connected with the line 63 supplying liquid acidic materials from the separator 43, and the resulting line 2 which optionally may be connected with the pipe 64 for injecting chemicals (into the solvent rich slurry in the line 2) such as a water solution of sodium carbonate and calcium acetate or a calcium salt of another carboxylic acid for example in an amount in the range of 1% of the weight of the coal being subjected to liquefaction in said process, for a methylation and alkylation of phenols, line 2 feeding then the mixer 3.

As many possible embodiments may be made of the invention without departing from the scope thereof, it is to be understood that all matter herein set forth or shown in the accompanying drawning is to be interpreted as illustrative and not in a limiting sense.

What I claim is:

1. In a process for hydrogenating and liquefying coal, wherein coal is subjected in a coal liquefaction medium to the chemical action of hydrogen under elevated temperature and pressure, in which process gasiform products are separated from hydrogenated slurryform products comprising liquid and solid products including materials with structures composed of acidic phenolic components and basic amino-components, the improvement for increasing coal conversion rates, being characterized by agitating the slurryform products in the presence of an alkaline hydroxide in the presence of water, for binding acidic phenolic components in said products to form phenolic salts and lower the visocity of the slurryform, separating the slurryform which was agitated into a solid residue rich portion, a liquid product portion rich in phenolic compounds, and a liquid portion comprising amines, subjecting the separated liquid product portion rich in phenolic salts to chemical treatment with an inorganic acid for converting these phenolic compounds into free phenols, and recycling and admixing at least a part of these phenols to said coal liquefaction medium.

2. The process of claim 1 further comprising recycling and admixing a part of said solid residue to said coal liquefaction medium.

3. The process of claim 1, wherein admixing, for the purpose of alkylating phenols, sodium carbonate with a calcium salt of a carboxylic acid to the phenols being recycled and admixed to said coal liquefaction medium.

4. The process of claim 1 further comprising subjecting at least a part of the separated liquid portion comprising amines to the recovery of purified valuable amines.

5. In a process for hydrogenating and liquefying coal, wherein coal is subjected in a coal liquefaction medium to the chemical action of hydrogen under elevated temperature and pressure, in which process gasiform products are separated from hydrogenated slurryform products comprising liquid and solid products including materials with structures composed of acidic phenolic components and basic amino-components, the improvement for increasing coal conversion rates, being characterized by agitating the slurryform products in the presence of an alkaline hydroxide in the presence of water, for binding acidic phenolic components in said products to form phenolic salts and lower the viscosity of the slurryform, separating the slurryform which was agitated into a solid residue rich portion, a liquid product portion rich in phenolic compounds, and a liquid portion comprising amines, and recycling and admixing at least a part of the liquid portion comprising amines to said liquefaction medium.

6. The process of claim 5 further comprising recycling and admixing a part of said solid residue to said coal liquefaction medium.

7. The process of claim 5 further comprising subjecting at least a part of the separated liquid portion comprising amines to the recovery of purified valuable amines.

8. In a process for hydrogenating and liquefying coal, wherein coal is subjected in a coal liquefaction medium to the chemical action of hydrogen under elevated temperature and pressure, in which process gasiform products are separated from hydrogenated slurryform products comprising liquid and solid products including materials with structures composed of acidic phenolic components and basic amino-components, the improvement for increasing coal conversion rates being characterized by agitating the slurryform products in the presence of an inorganic acid in the presence of water, for binding basic components in the slurryform and lower the viscosity thereof, while forming salts and adducts of amines with said inorganic acid, separating the slurryform which was agitated into a solid residue portion, a liquid product portion rich in said salts and adducts, and a liquid portion comprising phenols, and recycling and admixing a part of the liquid portion comprising phenols to said coal liquefaction medium.

9. The process of claim 8 wherein said inorganic acid is selected from the group consisting of sulfuric acid and hydrochloric acid.

10. The process of claim 8 further comprising recycling and admixing a part of said solid residue portion to said coal liquefaction medium.

11. The process of claim 8 further comprising subjecting at least a part of the separated liquid portion comprising phenols to the recovery of purified valuable phenols.

12. In a process for hydrogenating and liquefying coal, wherein coal is subjected in a coal liquefaction medium to the chemical action of hydrogen under elevated temperature and pressure, in which process gasiform products are separated from hydrogenated slurryform products comprising liquid and solid products including materials with structure composed of acidic phenolic components and basic amino-components, the improvement for increasing coal conversion rates, being characterized by agitating the slurryform products in the persence of an inorganic acid in presence of water, for binding basic components in the slurryform and lower the viscosity thereof, while forming salts and adducts of amines with said inorganic acid, separating the slurryform which was agitated into a solid residue rich portion, a liquid product portion rich in said salts and adducts, and a liquid portion comprising phenols, subjecting the separated liquid product portion rich in said salts and adducts of amines to chemical treatment with an alkaline hydroxide for converting these salts and adducts into free amines, and recycling and admixing at least a part of these amines to said coal liquefaction medium.

13. The process of claim 12, wherein said inorganic acid is selected from the group consisting of sulfuric acid.

14. The process of claim 12 further comprising recycling and admixing a part of said solid residue portion to said coal liquefaction medium.

15. The process of claim 12 further comprising subjecting at least a part of the separated liquid portion comprising phenols to the recovery of purified valuable phenols.

* * * * *

UNITED STATES PATENT OFFICE

CERTIFICATE OF CORRECTION

Patent No. 4,056,460 Dated November 1, 1977

Inventor(s) John M. Malek

It is certified that error appears in the above-identified patent and that said Letters Patent are hereby corrected as shown below:

At col. 1, between lines 13 and 14, include the following:

The United States Government has rights in this invention pursuant to Contract No. DE-AC-01-76ET-10084 awarded by the U. S. Department of Energy.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*